US010727595B2

(12) United States Patent
Liu et al.

(10) Patent No.: US 10,727,595 B2
(45) Date of Patent: Jul. 28, 2020

(54) PATCH ANTENNA UNIT AND ANTENNA

(71) Applicant: Huawei Technologies Co., Ltd., Shenzhen (CN)

(72) Inventors: Liangsheng Liu, Shenzhen (CN); Xinhong Li, Hsinchu (TW); HuiLi Fu, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 2 days.

(21) Appl. No.: 16/049,104

(22) Filed: Jul. 30, 2018

(65) Prior Publication Data

US 2018/0337456 A1 Nov. 22, 2018

Related U.S. Application Data

(63) Continuation of application No. PCT/CN2016/109322, filed on Dec. 9, 2016.

(30) Foreign Application Priority Data

Jan. 30, 2016 (CN) ..... 2016 1 0071196

(51) Int. Cl.
*H01Q 1/38* (2006.01)
*H01Q 9/04* (2006.01)
(Continued)

(52) U.S. Cl.
CPC ..... *H01Q 9/0414* (2013.01); *H01Q 1/2283* (2013.01); *H01Q 1/48* (2013.01);
(Continued)

(58) Field of Classification Search
CPC ..... H01Q 1/2283; H01Q 1/22; H01Q 1/38; H01Q 1/48; H01Q 21/00; H01Q 21/0075;
(Continued)

(56) References Cited

U.S. PATENT DOCUMENTS 5,043,738 A * 8/1991 Shapiro ..... H01Q 21/065 343/700 MS
5,461,393 A * 10/1995 Gordon ..... H01Q 9/0407 343/700 MS
(Continued)

FOREIGN PATENT DOCUMENTS

CN 101064381 A 10/2007
CN 101141023 A 3/2008
(Continued)

OTHER PUBLICATIONS

Machine Translation and Abstract of Chinese Publication No. CN101141023, Mar. 12, 2008, 13 pages.
(Continued)

*Primary Examiner* — Tho G Phan
(74) *Attorney, Agent, or Firm* — Conley Rose, P.C.

(57) ABSTRACT

A patch antenna unit and an antenna that relate to the field of communications technology wherein the patch antenna unit includes a first support layer, a substrate, a second support layer, and an integrated circuit that are stacked. One radiation patch is attached to the first support layer, and one radiation patch is attached to the second support layer. A ground layer is disposed on the second support layer, a coupling slot is disposed on the ground layer, and a feeder corresponding to the coupling slot is disposed on the second support layer. The integrated circuit is connected to the first ground layer and the feeder. In the foregoing specific technical solution, a four-layer substrate is used for fabrication.

16 Claims, 12 Drawing Sheets

(51) Int. Cl.

| | |
|---|---|
| ***H01Q 1/22*** | (2006.01) |
| ***H01Q 21/06*** | (2006.01) |
| ***H01Q 23/00*** | (2006.01) |
| ***H01Q 21/00*** | (2006.01) |
| ***H01Q 1/48*** | (2006.01) |

(52) U.S. Cl.
CPC ..... *H01Q 9/045* (2013.01); *H01Q 9/0457* (2013.01); *H01Q 21/0075* (2013.01); *H01Q 21/065* (2013.01); *H01Q 23/00* (2013.01)

(58) Field of Classification Search
CPC ..... H01Q 21/065; H01Q 23/00; H01Q 9/04; H01Q 9/0414; H01Q 9/045; H01Q 9/0457
See application file for complete search history.

(56) References Cited

U.S. PATENT DOCUMENTS

| | | | | |
|---|---|---|---|---|
| 6,181,278 | B1 | 1/2001 | Kakimoto et al. | |
| 6,801,165 | B2 * | 10/2004 | Fang | H01Q 9/0414 343/700 MS |
| 6,806,831 | B2 * | 10/2004 | Johansson | H01Q 9/0414 343/700 MS |
| 6,995,711 | B2 * | 2/2006 | Killen | H01Q 1/38 343/700 MS |
| 2006/0017157 | A1 | 1/2006 | Yamamoto et al. | |
| 2009/0256752 | A1 | 10/2009 | Akkermans et al. | |
| 2010/0327068 | A1 | 12/2010 | Chen et al. | |
| 2011/0025574 | A1 * | 2/2011 | Tiezzi | H01Q 3/26 343/824 |
| 2012/0313832 | A1 | 12/2012 | Pazin et al. | |
| 2013/0088396 | A1 | 4/2013 | Han | |
| 2015/0015453 | A1 | 1/2015 | Puzella et al. | |

FOREIGN PATENT DOCUMENTS

| | | | |
|---|---|---|---|
| CN | 102195143 | A | 9/2011 |
| CN | 102299418 | A | 12/2011 |
| CN | 103066385 | A | 4/2013 |
| CN | 104157982 | A | 11/2014 |
| CN | 105552550 | A | 5/2016 |
| WO | 02089248 | A1 | 11/2002 |

OTHER PUBLICATIONS

Machine Translation and Abstract of Chinese Publication No. CN102195143, Sep. 21, 2011, 7 pages.
Machine Translation and Abstract of Chinese Publication No. CN103066385, Apr. 24, 2013, 10 pages.
Machine Translation and Abstract of Chinese Publication No. CN104157982, Nov. 19, 2014, 12 pages.
Machine Translation and Abstract of Chinese Publication No. CN105552550, May 4, 2016, 19 pages.
Foreign Communication From A Counterpart Application, Chinese Application No. 10720257570, Chinese Office Action dated Mar. 23, 2018, 7 pages.
Foreign Communication From A Counterpart Application, PCT Application No. PCT/CN2016/109322, English Translation of International Search Report dated Feb. 24, 2017, 2 pages.
Foreign Communication From A Counterpart Application, PCT Application No. PCT/CN2016/109322, English Translation of Written Opinion dated Feb. 24, 2017, 5 pages.
Foreign Communication From A Counterpart Application, European Application No. 16887743.9, Extended European Search Report dated Dec. 19, 2018, 8 pages.

* cited by examiner

PATCH ANTENNA UNIT AND ANTENNA

CROSS-REFERENCE TO RELATED APPLICATIONS

This application is a continuation of International Patent Application No. PCT/CN2016/109322 filed on Dec. 9, 2016, which claims priority to Chinese Patent Application No. 201610071196.2 filed on Jan. 30, 2016. The disclosures of the aforementioned applications are hereby incorporated by reference in their entireties.

TECHNICAL FIELD

The present application relates to the field of communications technologies, and in particular, to a patch antenna unit and an antenna.

BACKGROUND

Currently, in a wireless personal communications system (WPAN), application of a 60 gigahertz (GHz) frequency band has aroused people's interest, because people need a bandwidth higher than 7 GHz. Requirements for such a high bandwidth and a millimeter wave bring about many challenges for design of a microwave terminal application. Usually, a 60 GHz wireless front-end product is implemented based on expensive gallium arsenide microwave integrated circuits. Some wireless front-end products are implemented based on silicon-germanium integrated circuits to reduce costs. In such front-end products, an antenna and a chip are usually disposed together, or an antenna is included in a packaging body (system in chip or system on chip) using multiple modules. An antenna plays a very important role in the application of the 60 GHz bandwidth. In a latest technology, an antenna may be designed on a conventional dielectric layer substrate, and an antenna and a chip are simultaneously packaged into a packaging body using a multichip module (MCM) packaging technology. Therefore, costs and a size can be reduced, and a feature and specifications of a communications chip can be implemented, thereby enhancing competitiveness of the product.

In the other approaches, manners for implementing a 60 GHz antenna device in a packaging body mainly include: 1) a multi-layer dielectric layer substrate is used, where an antenna array is disposed on a first layer, a feeder is disposed on a second layer, and a ground plane is disposed on the second layer or a third layer to implement integration of a passive antenna device; and 2) an antenna is designed on an integrated circuit, a substrate is disposed below the integrated circuit, and a passive device is directly bonded to a chip using a packaging technology.

In other approaches, a 60 GHz antenna device is implemented on a substrate in a packaging body. The antenna is implemented in a feeder-to-slot manner. To match a slot antenna, the antenna is implemented by means of a slot bended for 90°. An input line of a slot feeder and an input line of the feeder are on a same straight line. With this design, an area is reduced and a bandwidth can be increased. The antenna structure is designed in a metal carrier with a forked slot, so that the antenna has a relatively high strength, and can be easily integrated with a metallic reflector. The antenna is generally fabricated based on a substrate with multiple layers of low temperature co-fired ceramic (LTCC).

However, when the antenna with the foregoing structure is used, in many processes for implementing antenna packaging, if the antenna uses slot feeding, an antenna gain is greatly affected by a fabrication process, and an antenna frequency bandwidth is not easily controlled. This integration manner cannot be implemented in some mass fabrication scenarios.

In other approaches, multiple support layers and a patch antenna array are disposed on a top layer of a substrate, a feeder between a first dielectric layer and a second dielectric layer is used for antenna feed-in, and a ground plane is disposed between the second dielectric layer and a third dielectric layer.

In other approaches, feed-in is performed on the second layer, if a return loss is −10 decibels (dB), a bandwidth is approximately 4.6 GHz; and a return loss of a 65 GHz antenna is only 7 dB. Because an antenna gain is relatively low, 16 patch antennas are used to increase the gain. Consequently, an area increases, and an antenna feature is not good.

SUMMARY

The present application provides a patch antenna unit and an antenna to improve efficiency of the antenna.

In a first aspect, an embodiment of the present application provides a patch antenna unit, and the patch antenna unit includes a first support layer, a substrate disposed on the first support layer in a stacked manner, a second support layer disposed on one side that is of the substrate and that is away from the first support layer, and an integrated circuit disposed on one side that is of the second support layer and that is away from the substrate, where a first radiation patch is attached to one side that is of the first support layer and that is away from the substrate; a second radiation patch is attached to one side that is of the substrate and that is away from the second support layer, and the first radiation patch and the second radiation patch are center-aligned; a first ground layer is disposed on one side that is of the second support layer and that faces the substrate, a coupling slot is disposed on the first ground layer, a feeder coupled and connected to the first radiation patch and the second radiation patch by means of the coupling slot is disposed on one side that is of the second support layer and that is away from the substrate; and the integrated circuit is electrically connected to the first ground layer and the feeder.

In the foregoing specific technical solution, a four-layer substrate is used for fabrication. A patch antenna unit is disposed on a first-layer copper sheet and a second-layer copper sheet. A third layer is used as a ground plane, and a coupling slot is disposed on the third layer, is used as a fourth layer to combine an integrated circuit and a pad, and is used for feed-in of a feeder. The coupling slot on the third layer may be used to effectively feed high-frequency signals of a full-frequency band of 57-66 GHz into an antenna on the two higher layers for radiation. Electromagnetic fields are generated at two ends of the feeder; a distributed current is induced by the two layers of radiation patches based on a magnetic field component in the electromagnetic fields and by means of the coupling slot; and an electromagnetic wave is generated based on the distributed current for radiation. A parasitic effect is reduced. In addition, a stacked structure increases an effective area of an antenna. A low parasitic parameter and a large effective area that are achieved provide the antenna with a high-bandwidth and high-gain performance effect. During the fabrication, no extra process is needed, and only a conventional process procedure for a printed circuit substrate is needed.

In an actual processing scenario, a copper coverage rate of each layer needs to be considered in actual substrate processing. When the copper coverage rate is relatively high, processing reliability and consistency are higher. Therefore, in a possible design, the patch antenna unit further includes a second ground layer that is disposed on the first support layer and that is disposed on the same layer as the first radiation patch, where a first slot is disposed between the second ground layer and the first radiation patch, and the second ground layer is electrically connected to the first ground layer. That is, copper is covered on the first support layer, and the first radiation patch is formed on the covered copper using a common processing technology such as etching.

Further, the patch antenna unit further includes a third ground layer that is disposed on the substrate and that is disposed on the same layer as the second radiation patch, where a second slot is disposed between the third ground layer and the second radiation patch, and the third ground layer is electrically connected to the first ground layer. A ground layer is disposed on different substrates to increase copper coverage rates of the substrates. In addition, use of the foregoing structure brings about the following effects: 1. electromagnetic compatibility (EMC) performance can be improved in actual chip integration; and 2. a forward direction radiation feature of an antenna is enhanced. An emulation has proved that an emulation gain in a case in which cooper sheets surrounding the antenna are grounded to form a ground layer is 0.5 dB greater than that in a case in which the cooper sheets are not grounded.

During specific disposing, widths of the first slot and the second slot are greater than or equal to 1/10 of a maximum operating frequency wavelength of the patch antenna unit.

The first ground layer and the integrated circuit are electrically connected using a fourth ground layer. The patch antenna unit further includes the fourth ground layer that is disposed on the second support layer and that is disposed on the same layer as the feeder, where a third slot is disposed between the fourth ground layer and the feeder, and the first ground layer is electrically connected to the integrated circuit using the fourth ground layer. The disposed fourth ground layer not only increases a copper coverage area, but also facilitates connection between the antenna structure and the integrated circuit.

In a specific fabrication process, the integrated circuit is connected to the fourth ground layer and the feeder using a solder ball. A connection effect is good.

In an exemplary embodiment, copper coverage rates of the first support layer, the second support layer, and the substrate range from 50% to 90%.

The first radiation patch and the second radiation patch are arranged in a center-aligned manner, and a ratio of an area of the first radiation patch to an area of the second radiation patch ranges from 0.9:1 to 1.2:1.

In a possible design, a value of a length L of the coupling slot ranges from 1/3 to 1/5 of an electromagnetic wavelength corresponding to a maximum power frequency of the patch antenna unit, a maximum width of the coupling slot ranges from 75% to 100% of L, and a minimum width of the coupling slot ranges from 20% to 30% of L.

In a specific structure, the coupling slot includes two parallel first slots and a second slot that is disposed between the two first slots and that connects the two first slots; a length direction of the first slot is perpendicular to a length direction of the second slot; the feeder is a rectangular copper sheet; a length direction of the feeder is perpendicular to the length direction of the second slot; and a vertical projection of the feeder on a plane in which the coupling slot is located crosses the second slot.

In specific material selection, the first support layer, the second support layer, the substrate, and an integrated circuit transistor plate are resin substrates.

According to a second aspect, an embodiment of the present application provides an antenna, and the antenna includes a feed and tree-like branches connected to the feed. A node of each branch is provided with a power splitter. An end branch of the tree-like branches is connected to any patch antenna unit described above.

In the foregoing specific technical solution, a four-layer substrate is used for fabrication. A patch antenna unit is disposed on a first-layer copper sheet and a second-layer copper sheet. A third layer is used as a ground plane, and a coupling slot is disposed on the third layer, is used as a fourth layer to combine an integrated circuit and a pad, and is used for feed-in of a feeder. The coupling slot on the third layer may be used to effectively feed high-frequency signals of a full-frequency band of 57-66 GHz into an antenna on the two higher layers for radiation. Electromagnetic fields are generated at two ends of the feeder; a distributed current is induced by the two layers of radiation patches based on a magnetic field component in the electromagnetic fields and by means of the coupling slot; and an electromagnetic wave is generated based on the distributed current for radiation. A parasitic effect is reduced. In addition, a stacked structure increases an effective area of an antenna. A low parasitic parameter and a large effective area that are achieved provide the antenna with a high bandwidth and a high gain. During the fabrication, no extra process is needed, and only a conventional process procedure for a printed circuit substrate is needed.

DETAILED DESCRIPTION

Figure 1:
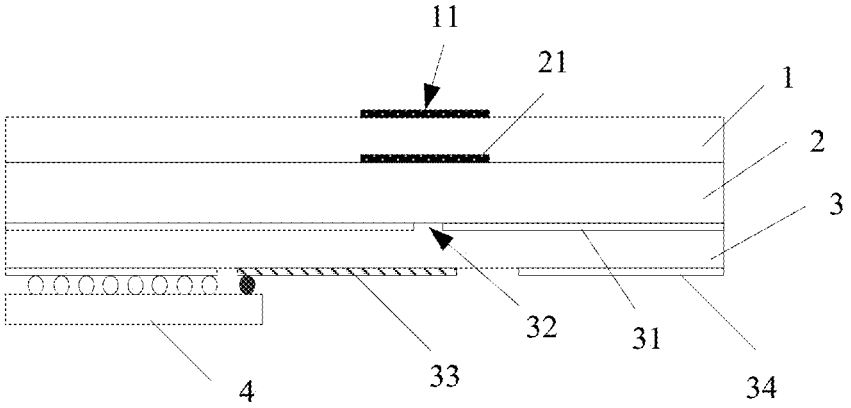
FIG. 1 is a pictorial view of a patch antenna unit according to an embodiment of the present application.

To make the objectives, technical solutions, and advantages of the present application clearer, the following further describes the present application in detail with reference to the accompanying drawings. The described embodiments are merely a part rather than all of the embodiments of the present application. All other embodiments obtained by a person of ordinary skill in the art based on the embodiments of the present application without creative efforts shall fall within the protection scope of the present application.

An embodiment of the present application provides a patch antenna unit, and the patch antenna unit includes a first support layer, a substrate disposed on the first support layer in a stacked manner, a second support layer disposed on one side that is of the substrate and that is away from the first support layer, and an integrated circuit disposed on one side that is of the second support layer and that is away from the substrate.

A first radiation patch is attached to one side that is of the first support layer and that is away from the substrate.

A second radiation patch is attached to one side that is of the substrate and that is away from the second support layer, and the first radiation patch and the second radiation patch are center-aligned.

A first ground layer is disposed on one side that is of the second support layer and that faces the substrate, a coupling slot is disposed on the first ground layer, a feeder coupled and connected to the first radiation patch and the second radiation patch by means of the coupling slot is disposed on one side that is of the second support layer and that is away from the substrate.

The integrated circuit is connected to the first ground layer and the feeder.

In the foregoing specific embodiment, a four-layer substrate (a first support layer, a substrate, a second support layer, and an integrated circuit) is used for fabrication. A first-layer copper sheet and a second-layer copper sheet that are respectively disposed on the first support layer and the substrate are antenna radiation units. A third-layer copper sheet (a copper sheet disposed on the second support layer) is used as a ground plane, and a coupling slot is disposed on the third-layer copper sheet, is used as a fourth layer to combine an integrated circuit and a pad, and is used for feed-in of a feeder. A first radiation patch and a second radiation patch are coupled and connected to the feeder. In the coupling, the coupling slot on the third layer may be used to effectively feed high-frequency signals of a full-frequency band of 57-66 GHz into an antenna on the two higher layers for radiation. In a specific coupling connection, electromagnetic fields are generated at two ends of the feeder; a distributed current is induced by the two layers of radiation patches based on a magnetic field component in the electromagnetic fields and by means of the coupling slot; and an electromagnetic wave is generated based on the distributed current for radiation. A parasitic effect is reduced. In addition, a stacked structure increases an effective area of an antenna. A low parasitic parameter and a large effective area that are achieved provide the antenna with a high bandwidth and a high gain. During the fabrication, no extra process is needed, and only a conventional process procedure for a printed circuit substrate is needed.

To facilitate understanding of a patch antenna unit provided in the embodiments of the present application, details are described below with reference to specific embodiments.

Figure 2:
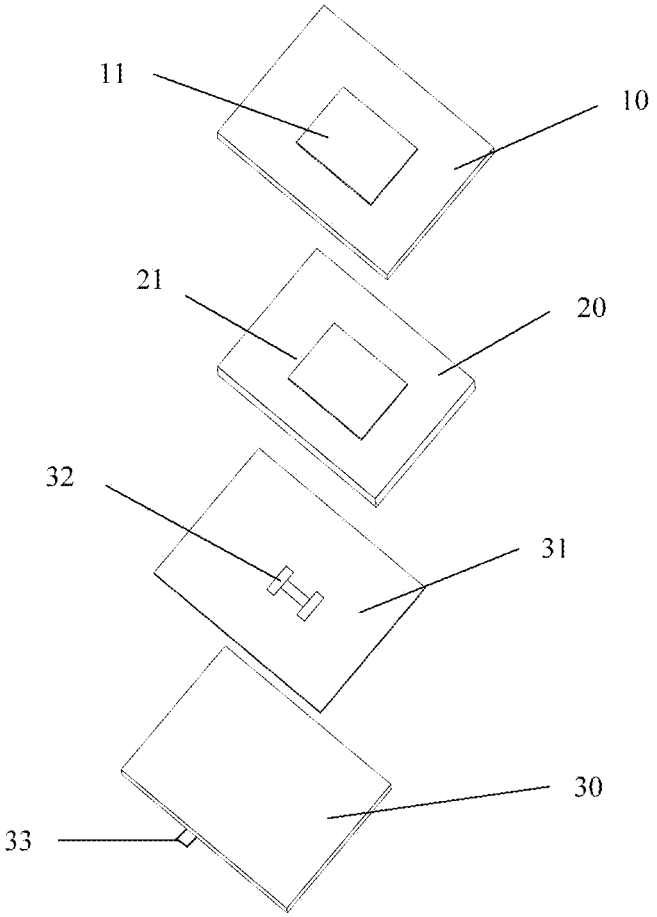
FIG. 2 is a main view of a patch antenna unit according to an embodiment of the present application.

Referring to FIG. 1 and FIG. 2, FIG. 1 shows a schematic structure diagram of a patch antenna unit according to an embodiment of the present application, and FIG. 2 shows a schematic exploded view of a patch antenna unit according to an embodiment of the present application.

An antenna structure provided in this embodiment of the present application includes four layers a first support layer 1, a substrate 2, a second support layer 3, and an integrated circuit 4. The first support layer 1, the substrate 2, the second support layer 3, and a substrate of a basement-layer transistor plate are made from resin materials, and implement a feature of a 57-66 GHz full-frequency band antenna using a relatively thin packaging substrate (for example, a total thickness is less than 650 micrometers (μm)).

A first radiation patch 11 is disposed on one side that is of the first support layer 1 and that is away from the second support layer 3, and a second radiation patch 21 is disposed on one side that is of the substrate 2 and that is away from the second support layer 3. The first radiation patch 11 and the second radiation patch 21 are disposed in a center-aligned manner. As shown in FIG. 1, radiation units on the two layers are center-aligned. During specific disposing, areas of the first radiation patch 11 and the second radiation patch 21 may be different; a ratio of the area of the first radiation patch 11 to the area of the second radiation patch 21 ranges from 0.9:1 to 1.2:1, and may be a ratio from 1:1 to 1.2:1, for example, 0.9:1, 0.95:1, 1:1, 1:1.1, or 1:1.2. Therefore, the first radiation patch 11 and the second radiation patch 21 may be slightly different during fabrication, thereby reducing fabrication process difficulty. Use of two layers of stacked radiation patches increases an effective area of an antenna, so that the antenna is provided with a high bandwidth and a high gain.

The second support layer 3 is used for grounding. A first ground layer is disposed on one side that is of the second support layer 3 and that faces the substrate 2, and a coupling slot 32 is disposed on the first ground layer. A feeder 33 coupled and connected to the first radiation patch 11 and the second radiation patch 21 by means of the coupling slot 32 is disposed on one side that is of the second support layer 3 and that is away from the substrate 2. In specific use, a coupling slot 32 on a third layer may be used to effectively feed high-frequency signals of a full-frequency band of 57-66 GHz into an antenna on the two higher layers for radiation. A parasitic effect is reduced, and the antenna provides a high bandwidth and a high gain.

Figure 3A:
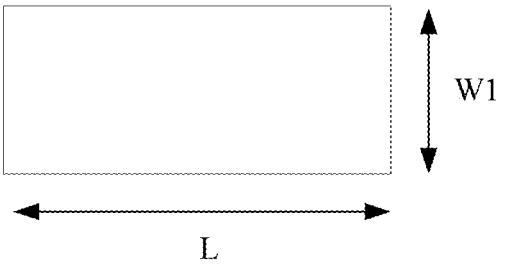
FIGS. 3A, 3B, 3C, 3D, and 3E illustrate different side views of a patch antenna unit according to an embodiment of the present application.
Figure 3B:
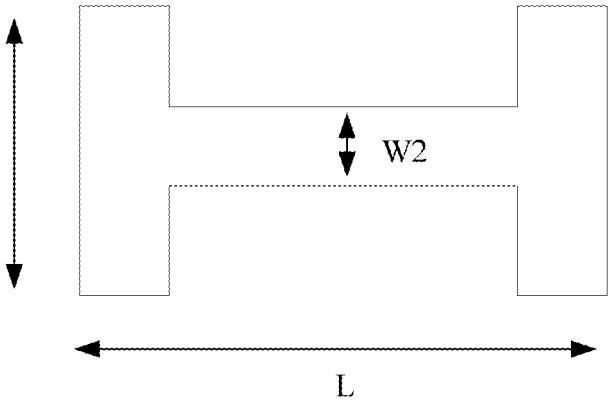
Figure 3C:
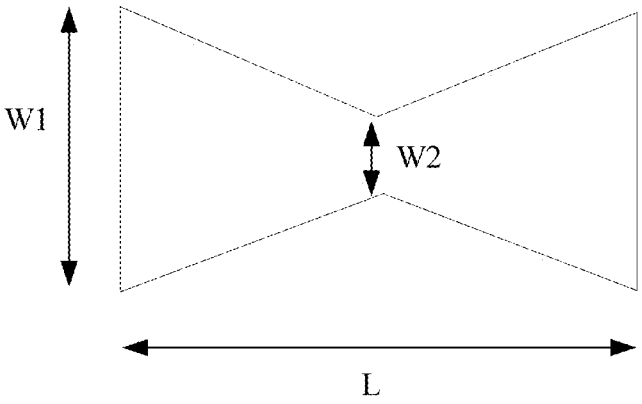
Figure 3D:
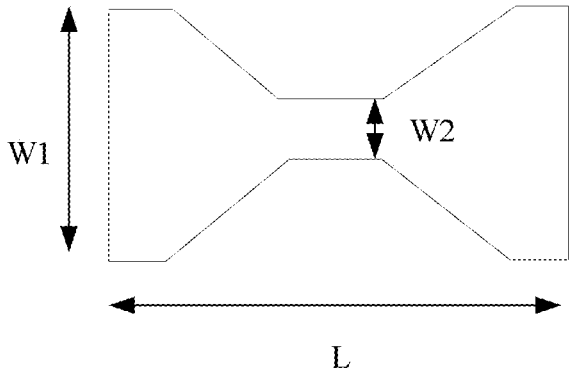
Figure 3E:
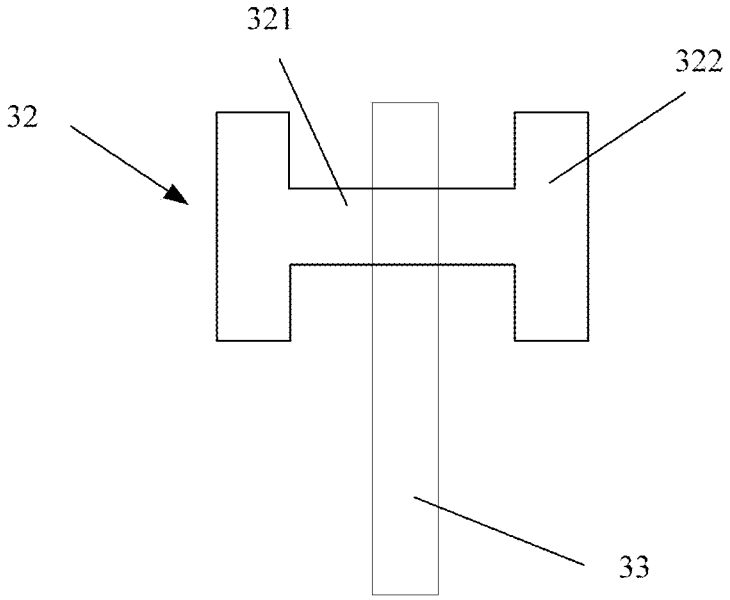

Referring to FIG. 3A to FIG. 3E, FIG. 3A to FIG. 3E show shapes of different coupling slots 32. As shown in FIG. 3A, a coupling slot 32 shown in FIG. 3A is a rectangle with a length L and a width W. During disposing, a value of the length L of the coupling slot 32 ranges from ⅓ to ⅕ of an electromagnetic wavelength corresponding to a maximum power frequency of a patch antenna unit. Preferably, the length L is ¼ of the electromagnetic wavelength corresponding to the maximum power frequency of the patch antenna unit. As shown in FIG. 3B, a coupling slot 32 shown in FIG. 3B includes two parallel first slots and a second slot that is disposed between the two first slots and that connects the two first slots. A length direction of the first slot is perpendicular to a length direction of the second slot. The length of the first slot is L, and a maximum width of the first slot is W1, and a minimum width of the first slot is W2. A value of the length L of the coupling slot 32 ranges from ⅓ to ⅕ of the electromagnetic wavelength corresponding to the maximum power frequency of the patch antenna unit. A maximum width of the coupling slot 32 ranges from 75% to 100% of L, for example, 75%, 80%, 90%, or 100%. A minimum width of the coupling slot 32 ranges from 20% to 30% of L, for example, 20%, 25%, or 30%. When the coupling slot 32 corresponds to the feeder 33, as shown in FIG. 3E, the coupling slot 32 includes two parallel first slots and a second slot that is disposed between the two first slots and that connects the two first slots. A length direction of the first slot is perpendicular to a length direction of the second slot. The feeder 33 is a rectangular copper sheet. A length direction of the feeder is perpendicular to the length direction of the second slot, and a vertical projection of the feeder on a plane in which the coupling slot is located crosses the second slot. The feeder 33 feeds signals into a first radiation patch and a second radiation patch by means of the coupling slot 32.

During specific disposing, as shown in FIG. 1, a first ground layer 31 is electrically connected to an integrated circuit 4, using a fourth ground layer 34. The fourth ground layer 34 is disposed on one side that is of the second support layer and that is away from the substrate 2. The fourth ground layer 34 and the feeder 33 are disposed on a same layer, and a third slot is disposed between the fourth ground layer 34 and the feeder 33. The first ground layer 31 is electrically connected to the integrated circuit 4 using a second ground layer. The disposed fourth ground layer 34 not only increases a copper coverage area, but also facilitates connection between the antenna structure and the integrated circuit 4. Connection between a ground layer and the integrated circuit 4 is implemented using the disposed fourth ground layer 34. During specific connection, a grounding circuit in the integrated circuit 4 is connected to the fourth ground layer 34 by means of soldering using a solder ball. The feeder 33 in the integrated circuit 4 is connected to the feeder 33 on the fourth ground layer 34 using a solder ball. This ensures reliability of connection between the ground layer and the feeder 33 and a circuit in the integrated circuit 4, thereby ensuring conduction stability.

Figure 4:
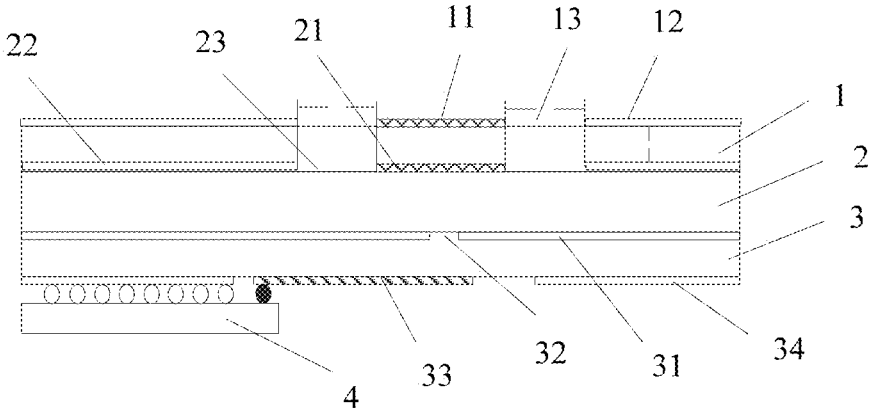
FIG. 4 is another schematic structural diagram of a patch antenna unit according to an embodiment of the present application.

As shown in FIG. 4, FIG. 4 shows a schematic structural diagram of another patch antenna unit according to an embodiment of the present application.

In the structure shown in FIG. 4, structures and connection manners of a first radiation patch 11, a second radiation patch 21, ground connection, slot feeding, and an integrated circuit 4 are the same as those of the patch antenna unit shown in FIG. 1, and details are not described herein again.

In an actual processing scenario, a copper coverage rate of each layer needs to be considered in actual processing of a substrate 2. When the copper coverage rate is relatively high, processing reliability and consistency are higher. Therefore, in a possible design, a second ground layer 12 is disposed on one side that is of a first support layer 1 and that is away from the substrate 2, and the second ground layer 12 and the first radiation patch 11 are disposed on a same layer. A first slot 13 is disposed between the second ground layer 12 and the first radiation patch, and the second ground layer 12 is electrically connected to a first ground layer 31. That is, copper is covered on the first support layer 1, and the first radiation patch is formed on the covered copper using a common processing technology such as etching.

Further, a second ground layer 22 is disposed on one side that is of the substrate 2 and that is away from a second support layer 3, and the second ground layer 22 is electrically connected to the first ground layer 31. The second ground layer 22 and the second radiation patch 21 are disposed on a same layer, and a second slot 23 is disposed between the second ground layer 22 and the second radiation patch 21. A ground layer is disposed on different substrates 2 to increase copper coverage rates of the substrates 2. In addition, use of the foregoing structure brings about the following effects: 1. EMC performance can be improved in actual chip integration; and 2. a forward direction radiation feature of an antenna is enhanced. An emulation has proved that an emulation gain in a case in which cooper sheets surrounding the antenna are grounded to form a ground layer is 0.5 dB greater than that in a case in which the first ground layer 31 and the second ground layer 12 are not disposed.

During specific disposing, widths of the first slot 13 and the second slot 23 are greater than or equal to 1/10 of a maximum operating frequency wavelength of the patch antenna unit.

In an exemplary embodiment, copper coverage rates of the first support layer 1, the second support layer 3, and the substrate 2 range from 50% to 90%. Use of the foregoing copper-covered structure facilitates processing of the first radiation patch 11 and the second radiation patch 21, thereby reducing processing difficulty. In addition, the first ground layer 31 and the second ground layer 12 that are additionally disposed may further effectively enhance a forward direction radiation feature of an antenna.

Figure 5:
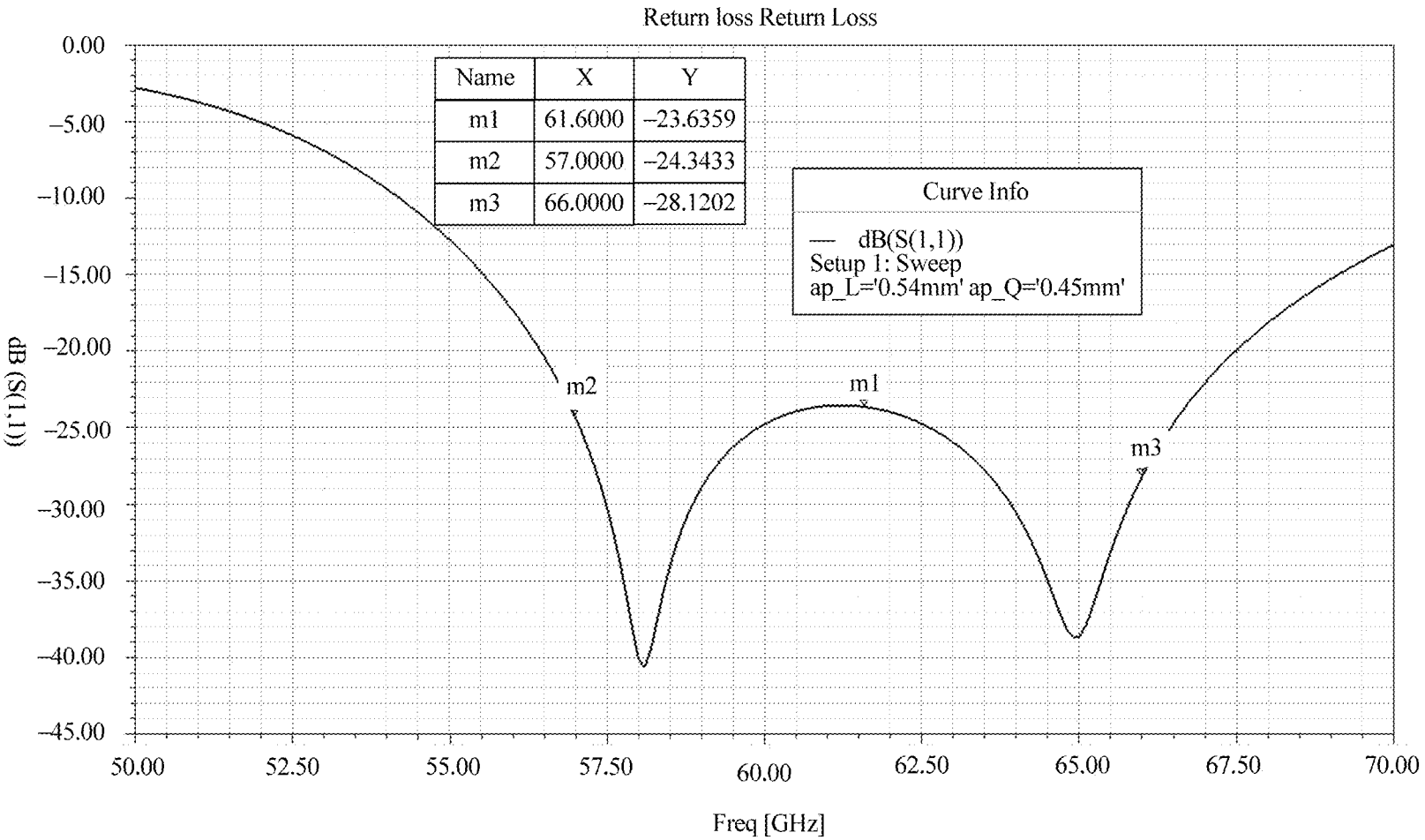
FIG. 5 is an emulation result of a patch antenna unit according to an embodiment of the present application.
Figure 6:
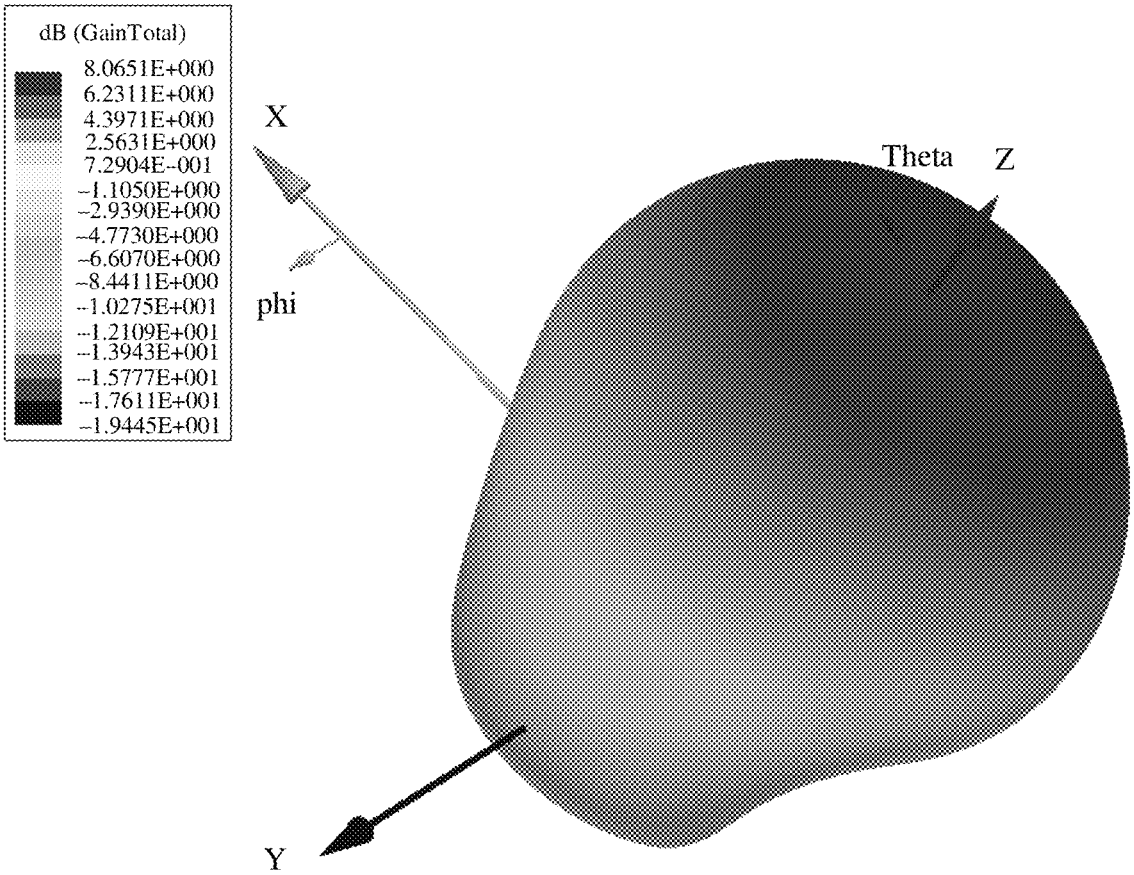
FIG. 6 is a three-dimensional gain diagram of a patch antenna unit according to an embodiment of the present application.

As shown in FIG. 5 and FIG. 6, FIG. 5 shows an emulation result of a return loss of the structure shown in FIG. 4, and FIG. 6 shows a three-dimensional gain diagram of the structure shown in FIG. 4. It can be learned from FIG. 5 that a wireless gigabit (WiGig) bandwidth with a return loss below −10 dB may be 54 GHz to 70 GHz. This represents that this design is a remarkable bandwidth design that has an extremely low signal loss.

An embodiment of the present application further provides an antenna, and the antenna includes a feed 30 and a power allocation network electrically connected to the feed 30. The power allocation network includes multiple patch antenna units 10 described in any one of the foregoing embodiments.

The patch antenna unit 10 is fabricated using a four-layer substrate 2. A patch antenna unit is disposed on a first-layer copper sheet and a second-layer copper sheet. A third layer is used as a ground plane, and a coupling slot 32 is disposed on the third layer, is used as a fourth layer to combine an integrated circuit and a pad, and is used for feed-in of a feeder. The coupling slot 32 on the third layer may be used to effectively feed high-frequency signals of a full-frequency band of 57-66 GHz into an antenna on the two higher layers for radiation. Electromagnetic fields are generated at two ends of the feeder; a distributed current is induced by the two layers of radiation patches based on a magnetic field component in the electromagnetic fields and by means of the coupling slot; and an electromagnetic wave is generated based on the distributed current for radiation. A parasitic effect is reduced. In addition, a stacked structure increases an effective area of an antenna. A low parasitic parameter and a large effective area that are achieved provide the antenna with a high bandwidth and a high gain. During the fabrication, no extra process is needed, and only a conventional process procedure for a printed circuit substrate is needed.

Figure 7:
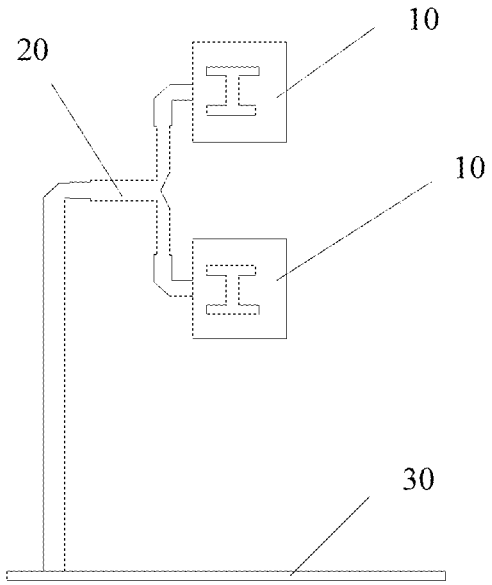
FIG. 7 is a schematic structural diagram of an antenna according to an embodiment of the present application.
Figure 8:
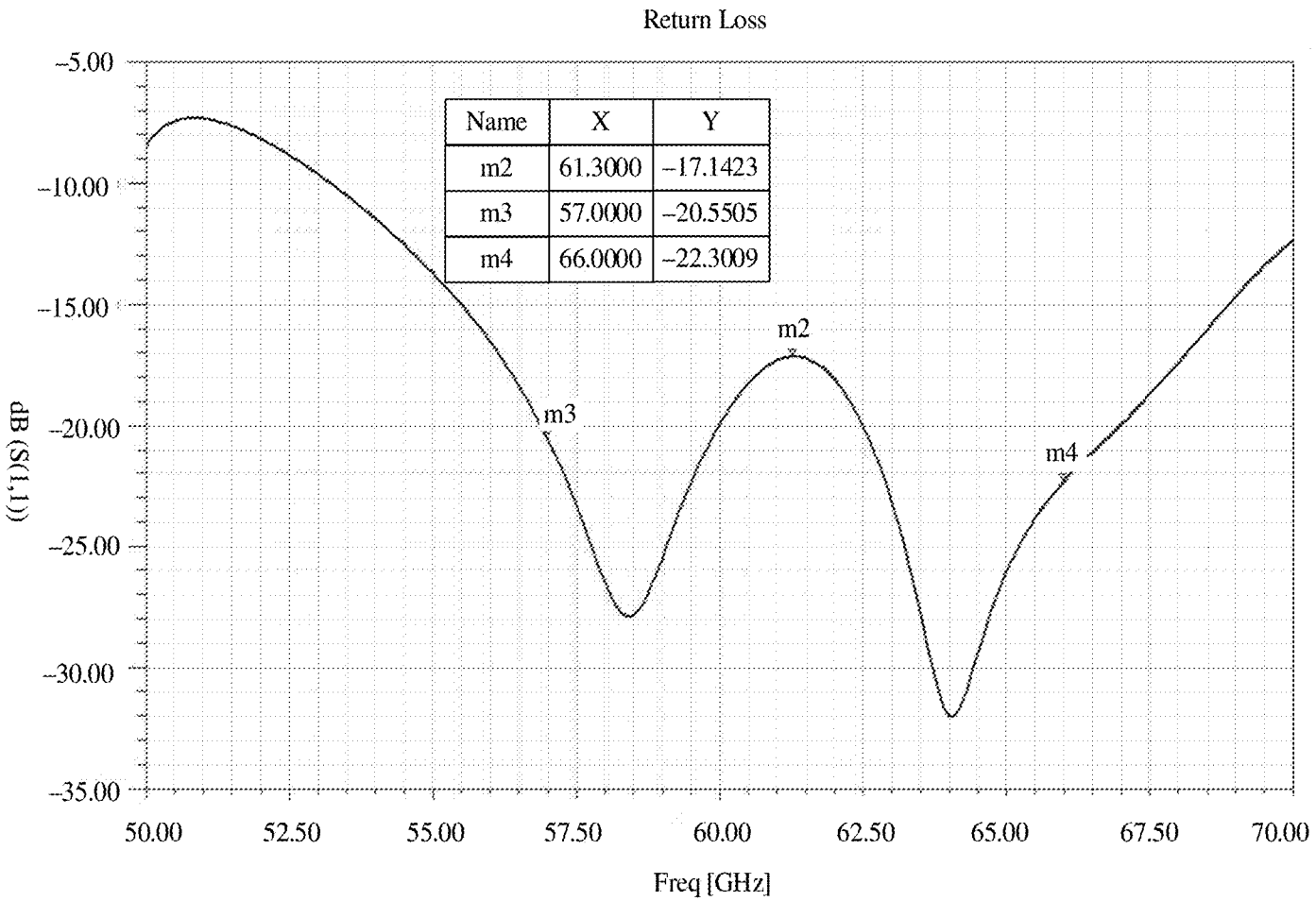
FIG. 8 is an emulation result of an antenna according to an embodiment of the present application.
Figure 9:
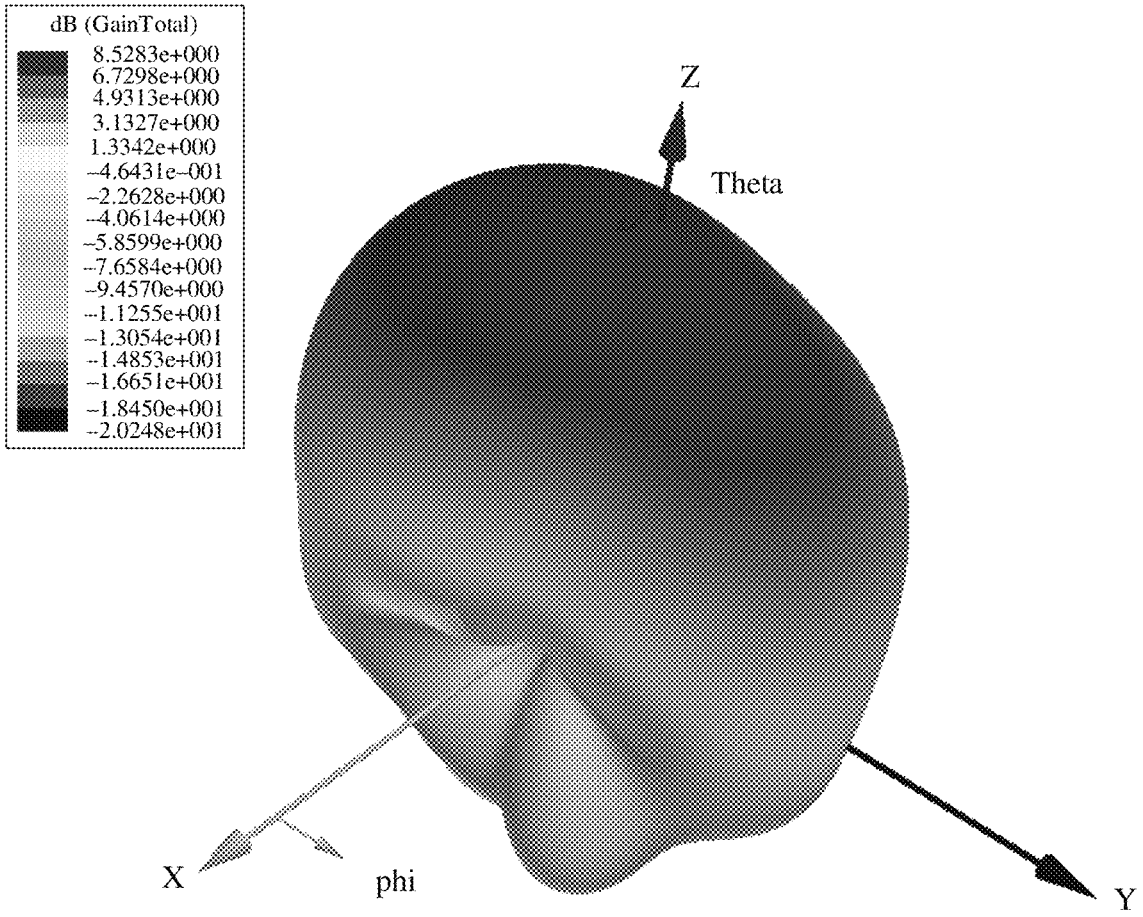
FIG. 9 is a three-dimensional gain diagram of an antenna according to an embodiment of the present application.
Figure 10:
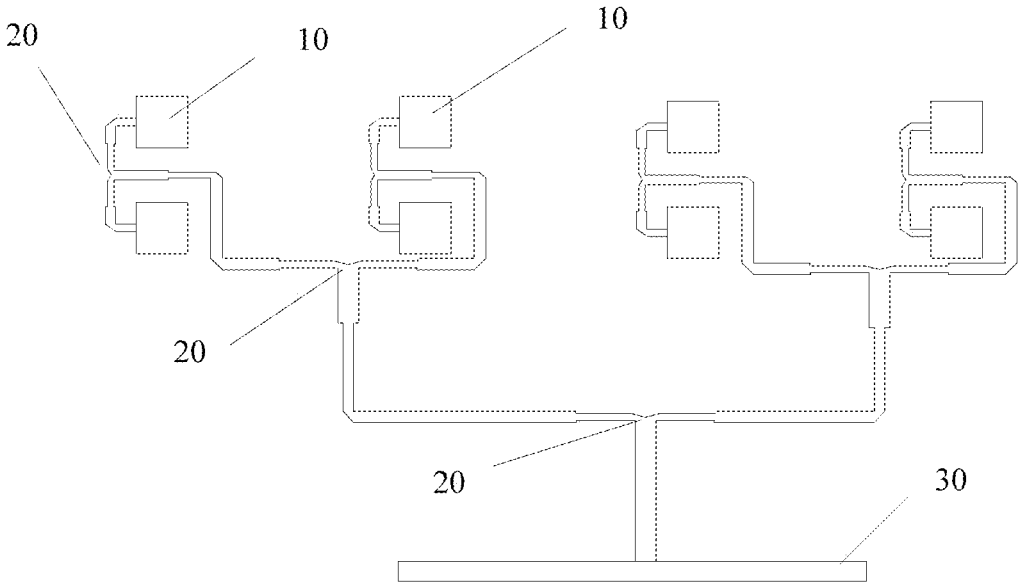
FIG. 10 is a schematic structural diagram of another antenna according to an embodiment of the present application.
Figure 11:
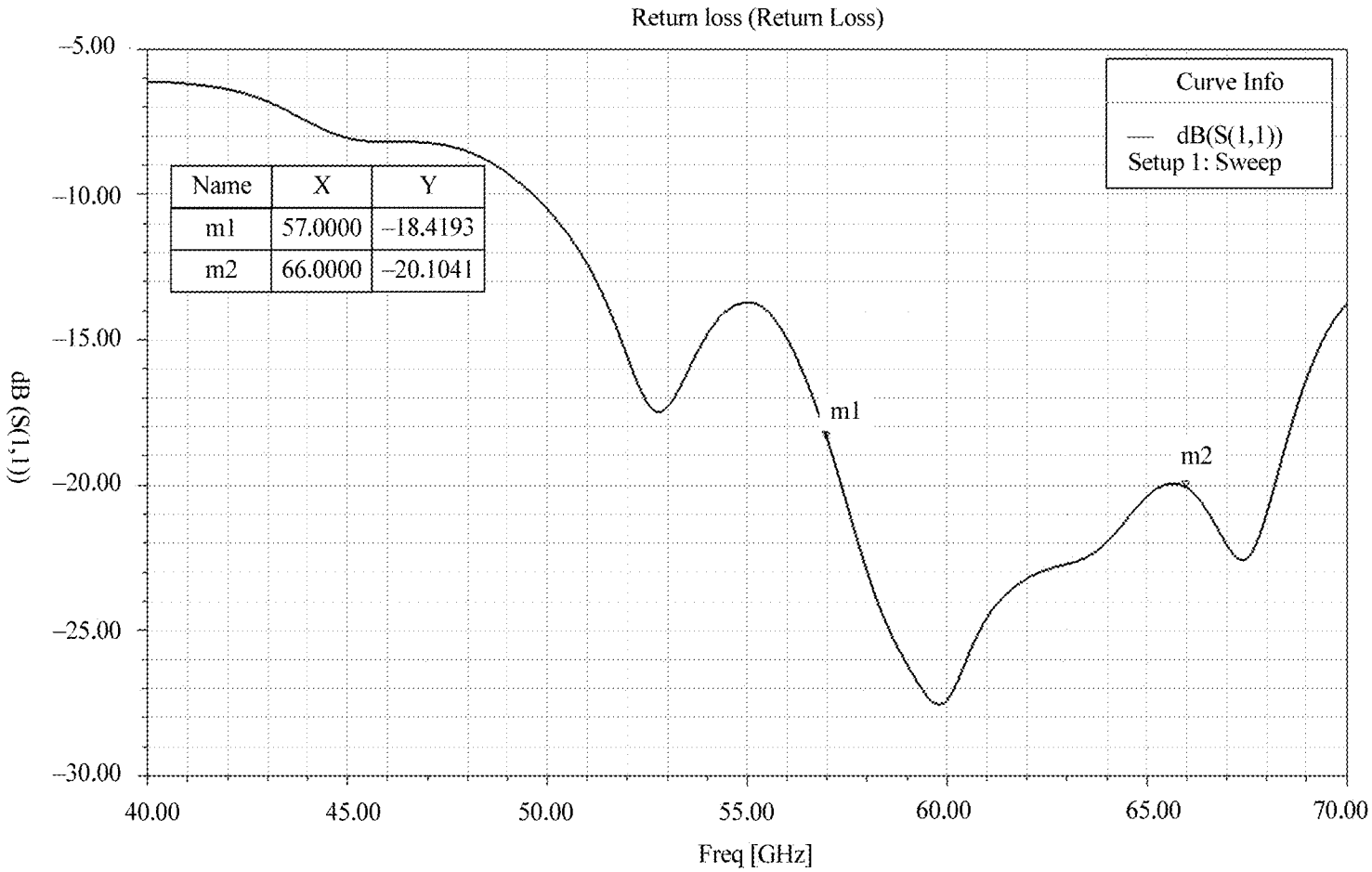
FIG. 11 is an emulation result of an antenna according to an embodiment of the present application.
Figure 12:
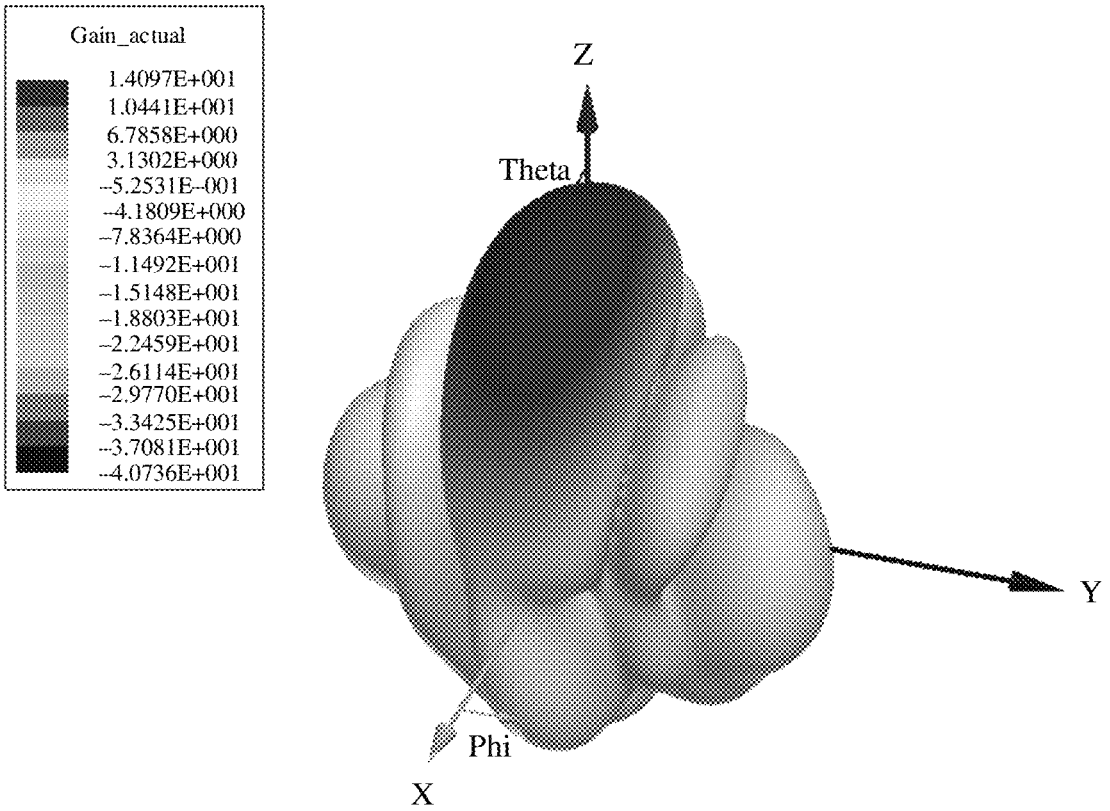
FIG. 12 is a three-dimensional gain diagram of an antenna according to an embodiment of the present application.

As shown in FIG. 7 and FIG. 10, FIG. 7 and FIG. 10 separately show different tree-like structures. Referring to FIG. 7, FIG. 7 shows a structure in which two patch antenna units 10 are used. In FIG. 7, a feed 30 is connected to a power splitter 20, and each power splitter 20 is connected to a patch antenna unit 10. As shown in FIG. 8 and FIG. 9, FIG. 8 shows an emulation result of a return loss of the structure shown in FIG. 7, and FIG. 9 shows a three-dimensional gain diagram of the structure shown in FIG. 7. It can be learned from data in FIG. 8 that a bandwidth with a return loss below −10 dB may be 54 GHz to 70 GHz. This represents that this design is a remarkable bandwidth design that has an extremely low signal loss. As shown in FIG. 10, FIG. 10 shows a schematic diagram of a structure in which multiple patch antenna units 10 are used. In FIG. 10, lines are branched using a power splitter 20, to form a tree-like structure. As shown in FIG. 10, a feed 30 is connected to a power splitter 20; an output end of the power splitter 20 is separated into two branches, and each branch is connected to a power splitter 20; an output end of the power splitter 20 is further branched; and so on, until a last branch is connected to a patch antenna unit. When the foregoing structure is used, as shown in FIG. 11 and FIG. 12, FIG. 11 shows an emulation result of a return loss of the structure shown in FIG. 10, and FIG. 12 shows a three-dimensional gain diagram of the structure shown in FIG. 10. It can be learned that a bandwidth with a return loss below −10 dB may be 55 GHz to 70 GHz. This represents that this design is a remarkable bandwidth design that has an extremely low signal loss.

In addition, an embodiment of the present application further provides a communications device, and the communications device includes the foregoing antenna.

In the foregoing specific technical solution, a four-layer substrate 2 is used for fabrication. A patch antenna unit is disposed on a first-layer copper sheet and a second-layer copper sheet. A third layer is used as a ground plane, and a coupling slot 32 is disposed on the third layer, is used as a fourth layer to combine an integrated circuit and a pad, and is used for feed-in of a feeder. The coupling slot 32 on the third layer may be used to effectively feed high-frequency signals of a full-frequency band of 57-66 GHz into an antenna on the two higher layers for radiation. A parasitic effect is reduced. In addition, a stacked structure increases an effective area of an antenna. A low parasitic parameter and a large effective area that are achieved provides the antenna with a high bandwidth and a high gain. During the fabrication, no extra process is needed, and only a conventional process procedure for a printed circuit substrate 2 is needed.

Obviously, a person skilled in the art can make various modifications and variations to the present application without departing from the scope of the present application. The present application is intended to cover these modifications and variations provided that they fall within the scope of protection defined by the following claims and their equivalent technologies.

What is claimed is:

1. A patch antenna unit, comprising:

a first support layer;

a substrate disposed on the first support layer in a stacked manner;

a second support layer that is disposed on one side of the substrate and that is away from the first support layer;

an integrated circuit that is disposed on one side of the second support layer that is away from the substrate;

a first radiation patch that is attached to one side of the first support layer that is away from the substrate;

a second radiation patch that is attached to one side of the substrate that is away from the second support layer, wherein the first radiation patch and the second radiation patch are center-aligned;

a first ground layer that is disposed on one side of the second support layer that faces the substrate, wherein a coupling slot is disposed on the first ground layer, wherein a feeder is coupled to the first radiation patch and the second radiation patch by the coupling slot that is disposed on the one side of the second support layer that is away from the substrate, and wherein the integrated circuit is electrically coupled to the first ground layer and the feeder; and a second ground layer that is disposed on the first support layer and that is disposed on a same layer as the first radiation patch, wherein a first slot is disposed between the second ground layer and the first radiation patch, and wherein the second ground layer is electrically coupled to the first ground layer.

2. The patch antenna unit of claim 1, further comprising a third ground layer that is disposed on the substrate and on a same layer as the second radiation patch, wherein a second slot is disposed between the third ground layer and the second radiation patch, and wherein the third ground layer is electrically coupled to the first ground layer.

3. The patch antenna unit of claim 2, wherein widths of the first slot and the second slot are greater than or equal to 1/10 of a maximum operating frequency wavelength of the patch antenna unit.

4. The patch antenna unit of claim 2, further comprising a fourth ground layer that is disposed on the second support layer and on a same layer as the feeder, wherein a third slot be is disposed between the fourth ground layer and the feeder, and wherein the first ground layer is electrically coupled to the integrated circuit using the fourth ground layer.

5. The patch antenna unit of claim 4, wherein the integrated circuit is coupled to the fourth ground layer and the feeder using a solder ball.

6. The patch antenna unit of claim 1, wherein a ratio of an area of the first radiation patch to an area of the second radiation patch ranges from 0.9:1 to 1.2:1.

7. The patch antenna unit of claim 1, wherein a value of a length (L) of the coupling slot ranges from 1/3 to 1/5 of an electromagnetic wavelength corresponding to a maximum power frequency of the patch antenna unit, wherein a maximum width of the coupling slot ranges from 75% to 100% of L, and wherein a minimum width of the coupling slot ranges from 20% to 30% of L.

8. The patch antenna unit of claim 7, wherein the coupling slot comprises two parallel first slots and a second slot that is disposed between the two parallel first slots and that couples the two parallel first slots, wherein a length direction of the first slot is perpendicular to a length direction of the second slot, wherein the feeder is a rectangular copper sheet, wherein a length direction of the feeder is perpendicular to the length direction of the second slot, and wherein a vertical projection of the feeder on a plane in which the coupling slot is located crosses the second slot.

9. An antenna, comprising:

a feed; and a power allocation network electrically coupled to the feed, wherein the power allocation network comprises multiple patch antenna units, and wherein each of the patch antenna units comprises:

a first support layer;

a substrate disposed on the first support layer in a stacked manner;

a second support layer that is disposed on one side of the substrate and that is away from the first support layer;

an integrated circuit that is disposed on one side of the second support layer that is away from the substrate;

a first radiation patch that is attached to one side of the first support layer that is away from the substrate;

a second radiation patch that is attached to one side of the substrate that is away from the second support layer, wherein the first radiation patch and the second radiation patch are center-aligned;

a first ground layer that is disposed on one side of the second support layer that faces the substrate, wherein a coupling slot is disposed on the first ground layer, wherein a feeder is coupled to the first radiation patch and the second radiation patch by the coupling slot that is disposed on the one side of the second support layer that is away from the substrate, and wherein the integrated circuit is electrically coupled to the first ground layer and the feeder; and a second ground layer that is disposed on the first support layer and that is disposed on a same layer as the first radiation patch, wherein a first slot is disposed between the second ground layer and the first radiation patch, and wherein the second ground layer is electrically coupled to the first ground layer.

10. The antenna of claim 9, further comprising a third ground layer that is disposed on the substrate and on a same layer as the second radiation patch, wherein a second slot is disposed between the third ground layer and the second radiation patch, and wherein the third ground layer is electrically coupled to the first ground layer.

11. The antenna of claim 10, wherein widths of the first slot and the second slot are greater than or equal to 1/10 of a maximum operating frequency wavelength of each of the patch antenna units.

12. The antenna of claim 10, further comprising a fourth ground layer that is disposed on the second support layer and on a same layer as the feeder.

13. The antenna of claim 12, wherein a third slot is disposed between the fourth ground layer and the feeder, and wherein the first ground layer is electrically coupled to the integrated circuit using the fourth ground layer.

14. The antenna of claim 13, wherein the integrated circuit is coupled to the fourth ground layer and the feeder using a solder ball.

15. The antenna of claim 9, wherein a value of a length (L) of the coupling slot ranges from 1/3 to 1/5 of an electromagnetic wavelength corresponding to a maximum power frequency of the patch antenna unit, wherein a maximum width of the coupling slot ranges from 75% to 100% of L, and wherein a minimum width of the coupling slot ranges from 20% to 30% of L.

16. The antenna of claim 15, wherein the coupling slot comprises two parallel first slots and a second slot that is disposed between the two parallel first slots and that couples the two parallel first slots, wherein a length direction of the first slot is perpendicular to a length direction of the second slot, wherein the feeder is a rectangular copper sheet, wherein a length direction of the feeder is perpendicular to the length direction of the second slot, and wherein a vertical projection of the feeder on a plane in which the coupling slot is located crosses the second slot.

* * * * *